US005174493A

United States Patent [19]

File

[11] Patent Number: 5,174,493

[45] Date of Patent: Dec. 29, 1992

[54] C AND Z FOLD REPLY ENVELOPE

[75] Inventor: Jerry E. File, Mundelein, Ill.

[73] Assignee: Moore Business Forms, Inc., Grand Island, N.Y.

[21] Appl. No.: 810,330

[22] Filed: Dec. 19, 1991

[51] Int. Cl.[5] ..... B65D 27/06

[52] U.S. Cl. ..... 229/301; 229/92.1; 229/92.3

[58] Field of Search ..... 229/300, 301, 92.1, 229/92.3

[56] References Cited

U.S. PATENT DOCUMENTS

| | | | |
|---|---|---|---|
| 1,708,574 | 4/1929 | Hazen | 229/92.3 |
| 2,044,541 | 6/1936 | Nigoul | 229/85 |
| 3,152,751 | 10/1964 | Hiersteiner | 229/73 |
| 3,498,528 | 3/1970 | Klein | 229/73 |
| 3,512,702 | 5/1970 | Pritchard | 229/73 |
| 3,982,689 | 9/1976 | Retrum | 229/313 |
| 4,081,127 | 3/1978 | Steidinger | 229/69 |
| 4,915,287 | 4/1990 | Volk et al. | 229/301 |
| 4,928,875 | 5/1990 | Hutchinson | 229/92.1 |
| 4,948,028 | 8/1990 | Vollowitz | 229/80 |

OTHER PUBLICATIONS

Z-Fold SPEEDISEAL ®, demonstration form, 1991.
C-Fold SPEEDISEAL ®, demonstration form, 1991.
Z-Fold SPEEDISEAL ® form.
Moore brochure "The SpeediSealer ® Pressure Seal System for Nonimpact Printers", Jun., 1990.
Moore Paragon "The PostMatic 830" brochure, Feb., 1979.
Moore "Pressure Seal . . . A New Age in Mailing Technology" brochure, Dec., 1990.
Moore Paragon "An Introduction to Pressure Seal . . . " brochure, Oct., 1990.

*Primary Examiner*—Stephen P. Garbe
*Attorney, Agent, or Firm*—Nixon & Vanderhye

[57] ABSTRACT

A business form comprises a mailer formed from a single roughly 8½×11 inch sheet, with a reply envelope nestable within the mailer, yet large enough to comply with minimum size postal regulations for mailable first class documents. The mailer sheet is C or Z folded into three sections of approximately equal size with perforations defining marginal portions and main panels. The return envelope has a first portion having a length approximately twice that of a second portion, and a free end. The first and second portions are connected together to define an envelope pocket having a length approximately equal to that of the second portion, including a common first edge opposite from the free end. A first fold line is formed in the first portion at or slightly spaced from the pocket and parallel to the common edge, and a second fold line is formed in the first portion between the first fold line and the free end and parallel to the first fold line. When the first portion is folded about the first fold line the reply envelope has a rectangular shape and dimensions slightly less than the dimensions of the main panels, and is nested within the mailer, and when folded about the second fold line forms a standard #6¾ envelope, with postage-placing indicia disposed between the first and second fold lines.

21 Claims, 5 Drawing Sheets

Fig. 4
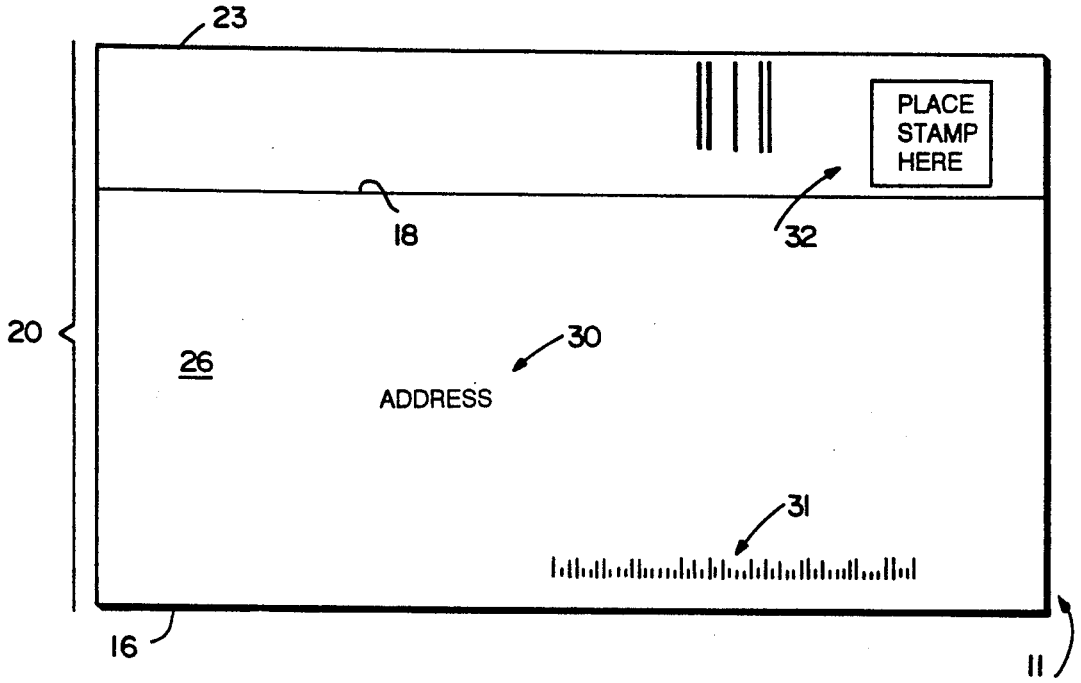
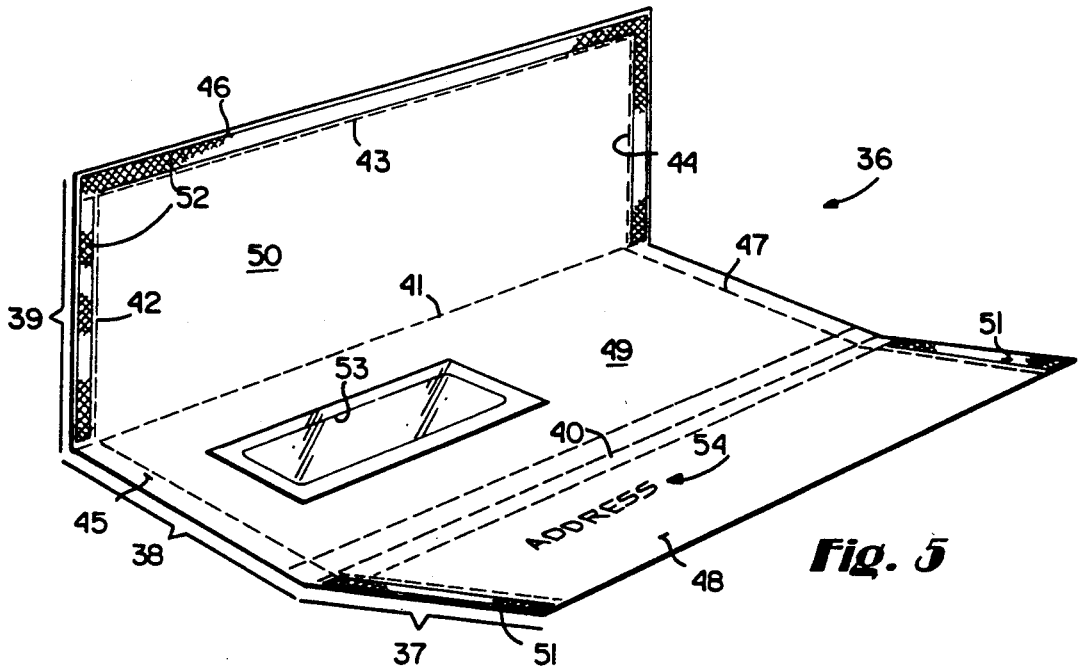
Fig. 5

C AND Z FOLD REPLY ENVELOPE

BACKGROUND AND SUMMARY OF THE INVENTION

Z fold or C fold mailer type business forms formed of a single sheet of approximately $8\frac{1}{2}\times11$ inch paper have become a very fast, cost effective, and efficient mailing and distribution system which can be mailed at regular postage rates. Such mailer forms are sold, for example, by Moore Business Forms, Inc. of Lake Forest, Ill. under the trademark "SEALERMATE®", and may be processed very effectively by both impact and non-impact printers. One type of SEALERMATE® form uses heat activated adhesive with marginal portions detachable along four edges of the form, while another uses pressure sensitive adhesive with the outside detachable along three edges, and with the interior panel detachable along a fourth. The pressure sensitive adhesive mailer is sealed utilizing the Moore 4800 SPEEDISEALER® system.

While the forms as described above are very useful, and versatile, it is not possible to use conventional return envelopes with such forms. A return envelope utilizable with such forms would have to be one having a maximum height of $2\frac{3}{4}$inches before it is used. However this is less than the height of a standard #$6\frac{3}{4}$ envelope, which has a height of $3\frac{5}{8}$ inches (and a length of $6\frac{1}{2}$ inches), which is approximately the minimum size for first class mailable envelopes under present United States Postal Service standards. The two obvious ways to get around that problem are to use a 14 inch length sheet to form the mailer, or provide a V fold, however both of these approaches also have drawbacks. The 14 inch length makes the form more expensive and more difficult to handle with some equipment, while the V fold is costly and may make the original form of an undesirable size aesthetically, or for efficient handling and processing.

According to the present invention, a paper return envelope is provided which can be utilized in conventional single sheet (C fold or Z fold) mailers yet fulfills the U.S.P.S. minimum requirements. The return envelope according to the present invention is initially disposed so that it has a height of roughly about $2\frac{3}{4}$ inches (with a length of about 6 $\frac{1}{2}$ inches), so that it is easily nestable in all conventional C fold and Z fold $8\frac{1}{2}\times11$ inch mailers formed from a single sheet. Yet it is expandable, once removed from the mailer, so that it has a height of roughly about $3\frac{5}{8}$ inches, so that it is the size of a standard #$6\frac{3}{4}$ envelope. Indicia is printed in a particular location of the envelope so as to clearly indicate to the user (without providing instructions that would be unacceptable on the outside of the envelope) how the envelope is to be expanded before used for a reply. The invention also contemplates a mailer containing the business reply envelope described above.

According to a first aspect of the present invention, a paper return envelope is provided comprising: A first portion having a length approximately twice that of a second portion, the first portion having a free end, and the first and second portions being connected together to define an envelope pocket having a length approximately equal to that of the second portion, including a common first edge of the first and second portions opposite from the free end of the first portion. A first fold line is formed in the first portion at or slightly spaced from the envelope pocket and parallel to the common edge, and a second fold line formed in the first portion between the first fold line. The envelope, when the first portion is folded about the first fold line has a rectangular shape and dimensions of roughly about $6\frac{1}{2}\times2\frac{3}{4}$ inches. The first portion of the return envelope has first and second opposite faces, and the second portion has first and second opposite faces. Address indicia is disposed on a part of the first face of the first portion overlying the second portion. A part of the second face of the first portion is in face to face contact with the second face of the second portion. And, indicia indicating that postage should be placed on the first face of the return envelope first portion, is provided, the postage indicating indicia disposed between the first and second fold lines on the first face.

The return envelope according to the invention also further comprises adhesive means operating between the second face of the first portion and the first face of the second portion to hold them together when the adhesive means is activated. For example the adhesive means may comprise a rewettable strip of adhesive placed on the second face of the first portion of the envelope adjacent the first end thereof. The distance between the first and second folds is roughly about $\frac{7}{8}$ inch, so envelope is folded about the second fold line the envelope has the approximate dimensions of a standard #$6\frac{3}{4}$ envelope.

The invention also relates to a business form comprising the following components. A mailer formed from a single rectangular sheet having dimensions roughly about $8\frac{1}{2}\times11$ inch, the sheet folded into three substantially equal sections, comprising first, second, and third sections, along longitudinal fold lines, the mailer having a completed exterior construction of a rectangular sheet roughly about $8\frac{1}{2}\times3\frac{2}{3}$ inches, and having four borders. Lines of weakness formed in each of the mailer sections to define in the mailer around the borders thereof marginal areas that are detachable from main panels of the mailer, the main panels being within the lines of weakness and being rectangular in configuration. And, a paper return envelope having a first portion having a length approximately twice that of a second portion, the first portion having a free end, and the first and second portions being connected together to define an envelope pocket having a length approximately equal to that of the second portion, including a common first edge of the first and second portions opposite from the free end of the first portion; a first fold line formed in the first portion at or slightly spaced from the envelope pocket and parallel to the common edge, and a second fold line formed in the first portion between the first fold line and the free end and parallel to the first fold line; the envelope when the first portion is folded about the first fold line having a rectangular shape and dimensions slightly less than the dimensions of the main panels, and the return envelope nested within the mailer between two of the sections.

The lines of weakness in the mailer may be provided in one main panel of the mailer along all four edges, and the one main panel may have four lines of weakness and rectangular dimensions of 2 $15/16\times7\frac{1}{2}$ inches, the return envelope still being readily nestable therein. That is, the mailer may comprise a conventional Z fold SEALERMATE®. Alternatively the mailer may comprise a conventional C fold SEALERMATE® mailer, in which case the dimensions are slightly larger, and the return envelope is even more easily nestable.

It is the primary object of the present invention to provide a return envelope, and mailer including a return envelope, that meets minimum U.S.P.S. regulations, yet may be utilized with a mailer formed from a single sheet of approximately 8 ½×11 inch paper. This and other objects of the invention will become clear from an inspection of the detailed description of the invention, and from the appended claims.

BRIEF DESCRIPTION OF THE DRAWINGS

FIG. 4 is a front view of the envelope of FIG. 3;

FIG. 5 is a top perspective view of a conventional C-fold mailer constructed from a single approximately 8½×11 inch sheet showing the mailer being folded;

DETAILED DESCRIPTION OF THE DRAWINGS

Figure 1:
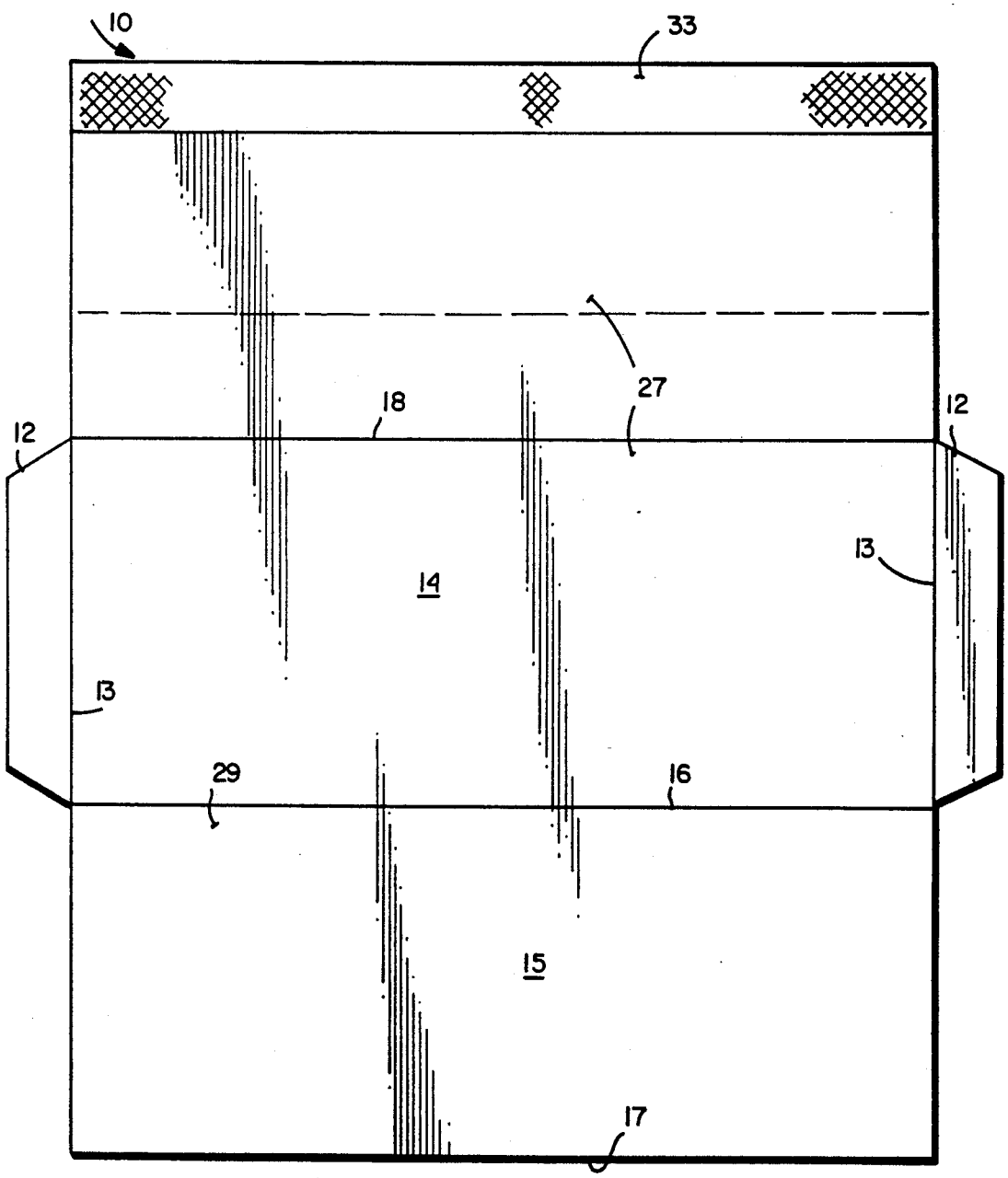
FIG. 1 is a plan view of a paper blank utilized to construct the reply envelope according to the present invention, showing the face that will be primarily the interior of the envelope.

A return envelope according to the present invention is shown in a blank form, prior to construction, generally by reference numeral 10 in FIG. 1, and in completed form in FIGS. 2 through 4, 6, and 9 by reference numeral 11.

The blank 10 illustrates that the envelope 11 is made from a single sheet of paper. The sheet of paper has a generally rectangular configuration except for a pair of side flaps 12. To construct the envelope it is only necessary to fold in the side flaps about lines 13 so that they touch the inner face of the middle portion 14 of the blank 10, and then fold up the bottom panel 15 about the fold line 16 to overlap the flaps 12. Adhesive is applied between the flaps 12 and the panel 15 permanently forming an envelope so that it has a pocket closed along three edges, and open at the edge 17 and fold line 18.

The envelope 11 comprises a first portion which (see FIGS. 3 and 4) includes the entire front part of the envelope 11 (see FIG. 4) as well as the flap 21. A second portion of the envelope comprises the portion 15 (the original lower panel illustrated by the blank of FIG. 1). The first portion 20, 21 comprises a free end 22, and the first and second portions 20, 21 and 15 are connected together including at a common first edge 16 (which was the fold line 16 in the blank of FIG. 1) opposite from the free end 22. The envelope 11 has a rectangular configuration and can assume two different dimensional configurations.

Figure 2:
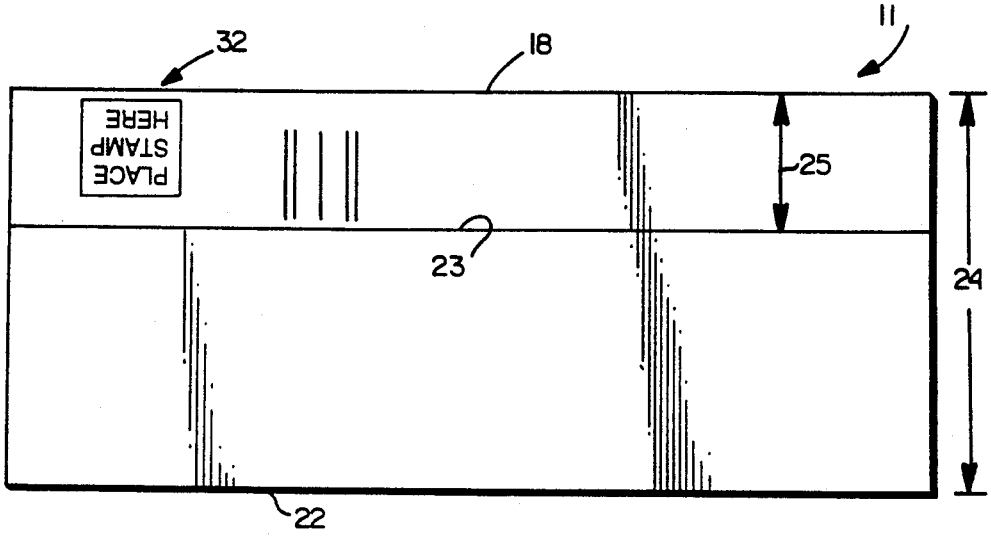
FIG. 2 is a rear view of the envelope constructed utilizing the blank of FIG. 1 when folded in its minimum size configuration.
Figure 3:
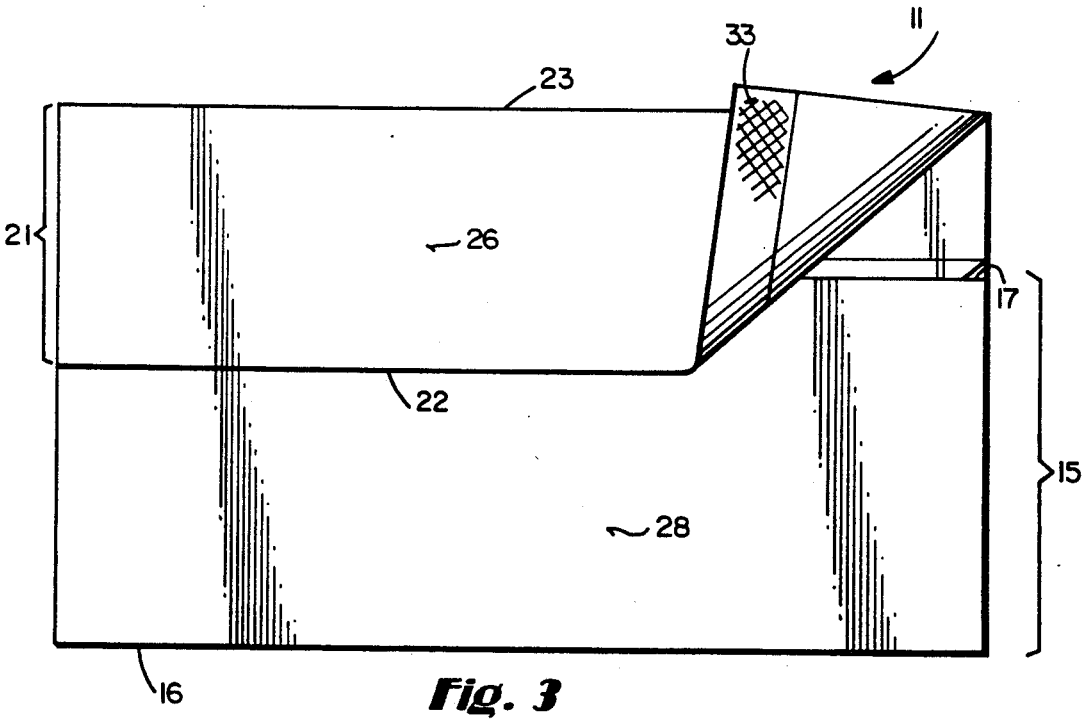
FIG. 3 is a rear view of the envelope of FIG. 2 in its maximum size configuration, showing it substantially sealed, however with one corner of the seal peeled back for clarity of illustration.

The line 18 comprises a first fold line for the envelope 11, and is at or slightly spaced from the pocket defined between the panels 14, 15 of the envelope blank, and is parallel to the common edge 16 (and also parallel to the free end 22). A second fold line 23 is also provided. The envelope 11 is dimensioned so that it has a width (i.e. the length of the common edge 16) of roughly about 6½ inches, and when folded about the fold line 18 has a height 24 of roughly about 2¾ inches. In that configuration—as illustrated in FIG. 2—the envelope 11 is readily nestable within a mailer, but it is smaller than U.S.P.S. standards for first class mail. However merely by folding the envelope 11 flap 21 about the second fold line 23 instead of the first fold line 18, it has the size of a standard #6¾ envelope—i.e. the dimension 25 of the portion between the fold lines 18, 23 is about ⅞ inch so that total dimensions of the envelope 11 are 3⅝ inch ×6½ inch when used as a return envelope.

The first portion 20, 21 of the return envelope 11 has opposite first and second faces. The first face 26 (see FIG. 4) is the outer face of the envelope 11, while the second face 27 (see FIG. 1) is the inner portion of the envelope. The second portion 15 also has first and second faces, the first face being the outer portion 28 (see FIG. 3). while the second face is the inner face 29 (see FIG. 1). The part of the second face 27 of the first portion 20, 21 comprising the panel 14 is in face to face contact with the second face 29 of the second portion 15, defining a pocket. On the first face 26 of the first portion 20, 21 address indicia is provided, preferably pre-printed (that is the return address of the organization sending out the original mailer). Part of the address indicia may comprise the bar coding 31.

Additionally, in order to clearly indicate to the recipient of the mailer how the return envelope is to be utilized, the postage indicating indicia is highly desirable. The indicia 32 is printed on that part of the first face 26 first portion 20, between the fold lines 18, 23. The indicia 32 has the same orientation as the indicia 30 so that the user will clearly see (see FIG. 2) that the indicia 32 is upside down if the envelope is utilized in the configuration of FIG. 2, whereas it is right side up when used in the configuration of FIG. 4, and therefore will use it in the FIG. 4 configuration.

As is conventional for envelopes, the return envelope 11 also has adhesive for sealing it. While the adhesive may take a wide variety of forms (such as permanent adhesive covered by a release liner, rewettable adhesive, pressure sensitive adhesive, etc.), and may be disposed in a number of different patterns and locations (e.g. on the face 28, on the face 27, or both), in the illustrative form in the drawings, a strip of rewettable glue 33 (see FIGS. 1 and 3) is provided on the face 27 adjacent the free end 22.

Figure 6:
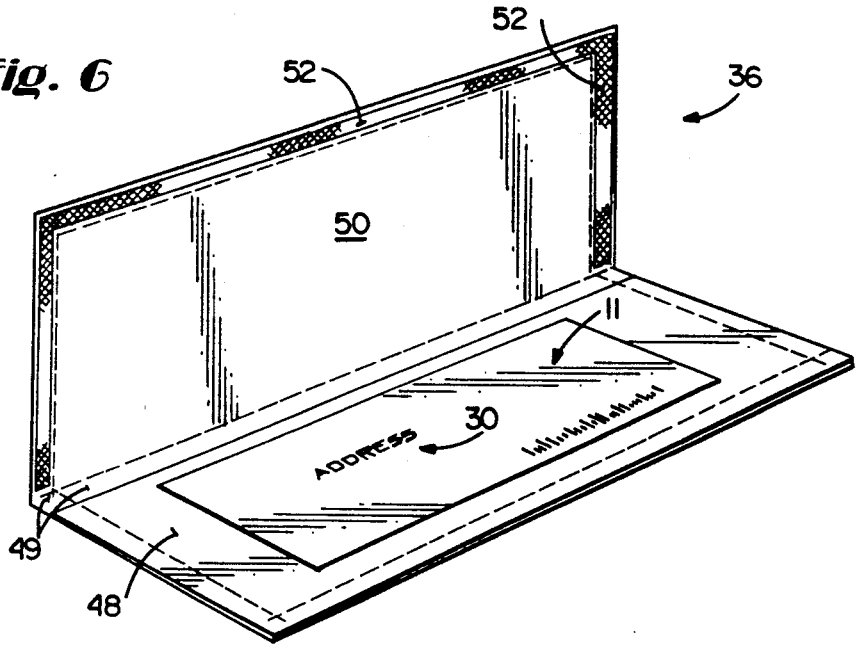
FIG. 6 is a view like that of FIG. 5 only showing the mailer after a complete first fold, and showing the return envelope according to the invention nested within the mailer.

FIGS. 5 and 6 illustrate an exemplary business form 36 according to the present invention which includes a return envelope 11 according to the present invention associated therewith. The form 36 may be processed in single sheets, or in continuous form, and subsequently burst.

The business form 36 comprises a mailer formed from a single rectangular sheet having dimensions of roughly (although by no means need it be exactly, being able to deviate about a half an inch or more) 8½×11 inches. The sheet is folded into three substantially equal sections 37, 38, 39 along longitudinal fold lines 40, 41 so that the mailer 36 has a completed exterior construction of a rectangular sheet roughly about 8½×3⅜ inches, and has four borders. Lines of weakness are formed in each of the sections 37 through 39 around the borders thereof to define marginal areas that are detachable from main panels of the mailer. For example, see the lines of weakness 42, 43, 44 which define the marginal areas 45, 46, and 47, and main panels 48, 49, 50. Adhesive, in this case heat activated adhesive, strips 51, 52 are provided in various ones of the marginal portions 45 through 47 for sealing the panels together. For example the strips 51 hold the panel 48 against the panel 49 (see FIG. 6), while the strips 52 are used to hold the panel in juxtaposition with the panel 48, with the envelope 11 nested between them.

The particular mailer 36 illustrated in FIGS. 5 and 6, except for the return envelope 11 provided therewith, is a conventional C-fold SEALERMATE® mailer sold by Moore Business Forms, Inc. A cut out 53, which may be covered by a glassene or clear material window, is formed in the second panel 49, with the address 54 of the addressee of the mailer 36 being provided on the inner portion of the first main panel 48 and visible through the cut out 53.

Figure 7:
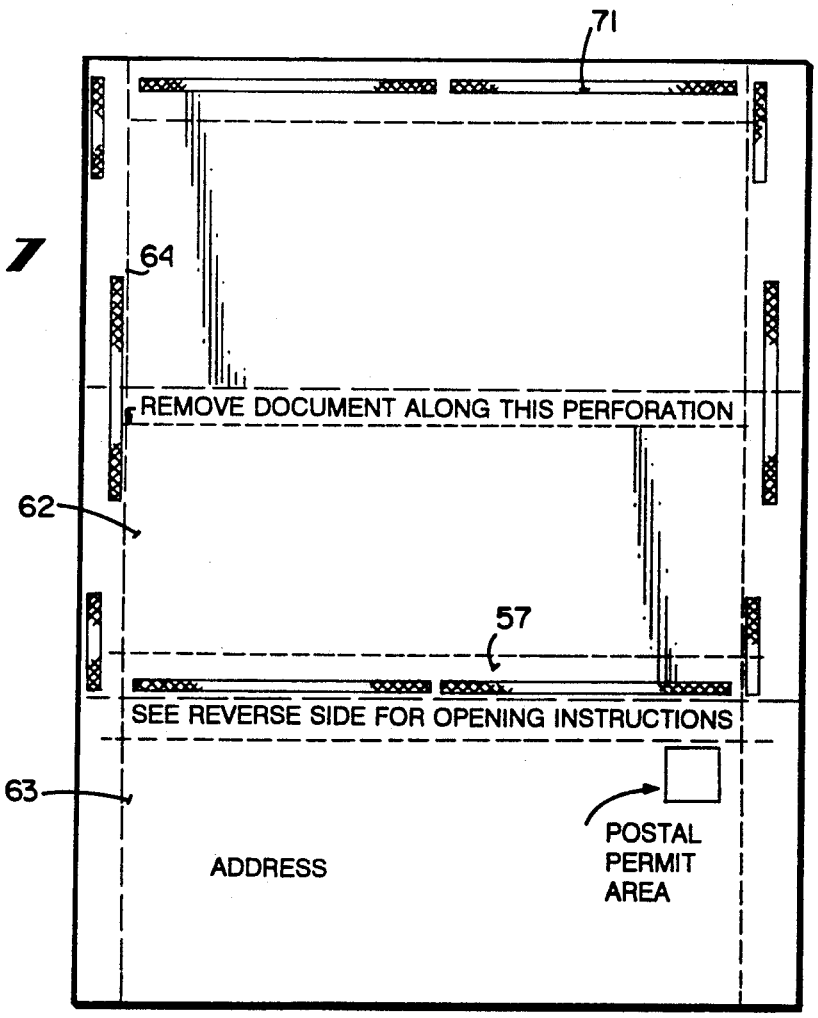
FIGS. 7 and 8 are plan views of the opposite faces of a conventional Z-fold mailer utilizable in the business form according to the invention.
Figure 9:
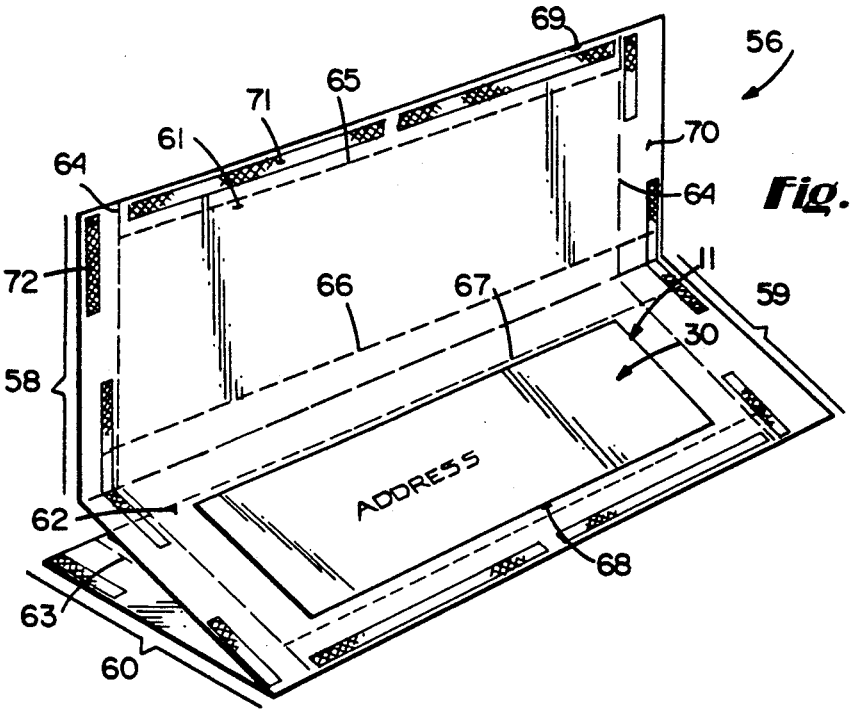
FIG. 9 is a top perspective view of the mailer of FIGS. 7 and 8 showing the mailer during folding, and showing the return envelope according to the invention nested therein.
Figure 8:
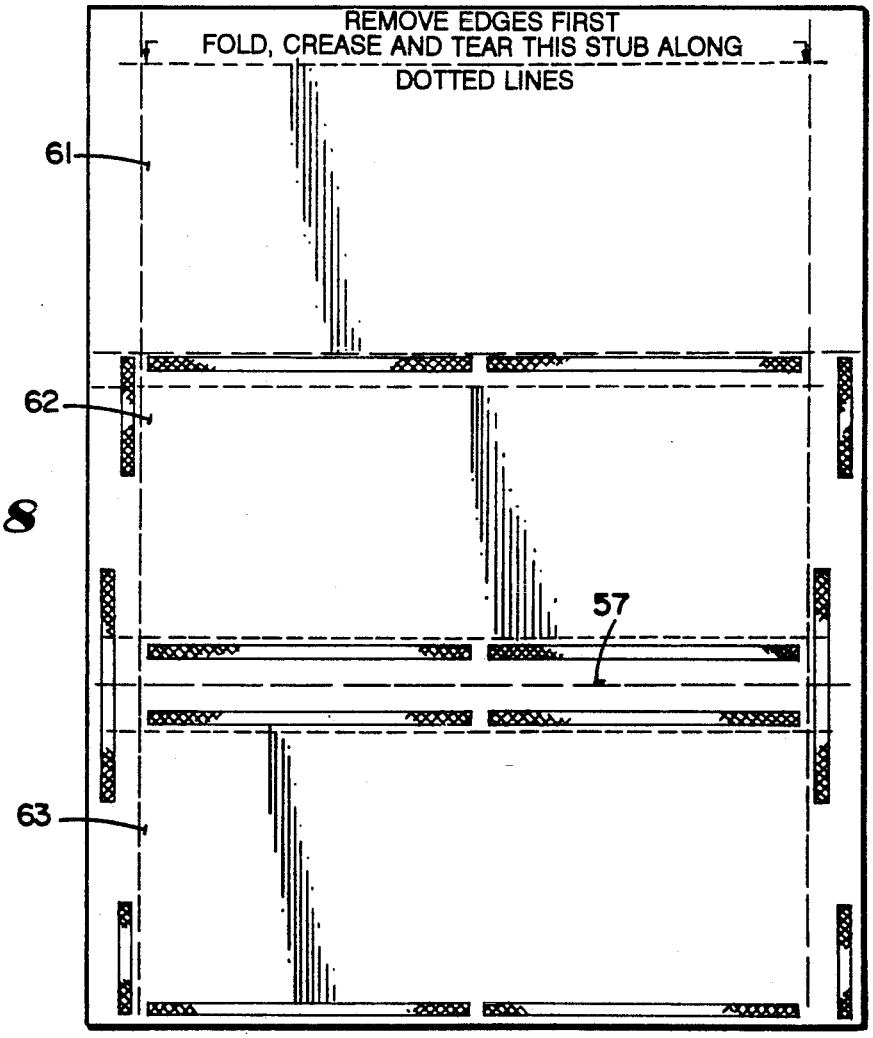

FIGS. 7 through 9 illustrate a second configuration of a business form according to the invention, the business form itself being illustrated generally by reference numeral 56 in FIG. 9, while the single sheet making up the business form (in conjunction with the return envelope 11) is illustrated by reference numeral 57 in FIGS. 7 and 8. The mailer 56 includes a first section 58, a second section 59, and a third section 60, with main panels 61, 62, 63, respectively formed in those sections 58 through 60 by lines of weakness (perforations) 64, 65, 66, 67, 68, which define marginal areas, e.g. 69, 70. In the marginal areas are provided patterns (e.g. discontinuous strips) of pressure sensitive adhesive 71, 72, etc., such as sold by Topan Moore of Japan under the designation TM 124. Note that the envelope 11 when the first portion 20, 21 is folded about the first fold line 18 nests within the areas of the main panels 61 through 63, and it may nest between the second panel 62 and either the first or third panels 61, 63.

When the addressee of the mailers 36, 56 receives the mailers, he or she detaches the edges thereof along the perforations (e.g. 42 through 44, 64 through 68, etc.) to reveal the inner contents of the mailer, namely the indicia printed on the main panels thereof. At the same time the return envelope 11 nested within the mailer 36, 56 may be removed. The addressee inserts a return coupon, check, or the like into the pocket of the return envelope 11, and then folds it about the second fold line 23 so that it has the configuration illustrated in FIGS. 3 and 4. The rewettable glue strip 33 is then wetted, and the envelope 11 is sealed, and postage placed at the postage placement indicia 32. The envelope 11 thus, while being readily nestable within the mailers 36, 56 which are formed from a single approximately $8\frac{1}{2}\times 11$ inch sheet, comprises a standard $\#6\frac{3}{4}$ envelope which fulfills the U.S.P.S. requirements.

While the invention has been herein shown and described in what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and products.

What is claimed is:

1. A paper return envelope comprising:

a first portion having a length approximately twice that of a second portion, said first portion having a free end, and said first and second portions being connected together to define an envelope pocket having a length approximately equal to that of said second portion, including a common first edge of said first and second portions opposite from said free end of said first portion;

a first fold line formed in said first portion at or slightly spaced from said envelope pocket and parallel to said common edge, and a second fold line formed in said first portion between said first fold line and said free end and parallel to said first fold line;

said envelope when said first portion is folded about said first fold line having a rectangular shape and dimensions of roughly about $6\frac{1}{2}\times 2\frac{3}{4}$ inches;

said first portion of said return envelope having first and second opposite faces, and said second portion has first and second opposite faces;

address indicia disposed on a part of said first face of said first portion overlying said second portion;

a part of said second face of said first portion in face to face contact with said second face of said second portion; and indicia indicating that postage should be placed on said first face of said return envelope first portion, said postage indicating indicia disposed between said first and second fold lines on said first face.

2. A return envelope as recited in claim 1 further comprising adhesive operating between said second face of said first portion and said first face of said second portion to hold them together when said adhesive is activated.

3. A return envelope as recited in claim 1 wherein the distance between said first and second fold lines is roughly about $\frac{7}{8}''$, so that when the envelope is folded about said second fold line the envelope has the approximate dimensions of a standard $\#6\frac{3}{4}$ envelope.

4. A business form comprising:

a mailer formed from a single rectangular sheet having dimensions roughly about $8\frac{1}{2}\times 11$ inch, said sheet folded into three substantially equal sections, comprising first, second, and third sections, along longitudinal fold lines, the mailer having a completed exterior construction of a rectangular sheet roughly about $8\frac{1}{2}\times 3\frac{3}{8}$ inches, and having four borders;

lines of weakness formed in said each of said mailer sections to define in said miler around the borders thereof marginal areas that are detachable from main panels of said mailer, said main panels being within said lines of weakness and being rectangular in configuration; and a paper return envelope having a first portion having a length approximately twice that of a second portion, said first portion having a free end, and said first and second portions being connected together to define an envelope pocket having a length approximately equal to that of said second portion, including a common first edge of said first and second portions opposite from said free end of said first portion, a first fold line formed in said first portion at or slightly spaced from said envelope pocket and parallel to said common edge, and a second fold line formed in said first portion between said first fold line and said free end and parallel to said first fold line; said envelope when said first portion is folded about said first fold line having a rectangular shape and dimensions slightly less than the dimensions of said main panels, and said return envelope nested within said mailer between two of said sections; said second fold line being spaced from said first fold line a distance sufficient to provide final dimensions of said return envelope, when mailed, which meet or exceed minimum requirements for a mailable document.

5. A business form as recited in claim 4 wherein said first portion of said return envelope has first and second opposite faces, and said second portion has first and second opposite faces; address indicia disposed on a part of said first face overlying said second portion; and a part of said second face of said first portion in face to face contact with said second face of said second portion.

6. A business form as recited in claim 5 further comprising adhesive operating between said second face of said first portion and said first face of said second portion to hold them together when said adhesive is activated.

7. A business form as recited in claim 6 wherein said adhesive comprises an adhesive pattern formed on said first portion second face adjacent said free end thereof.

8. A business form as recited in claim 7 wherein said adhesive comprises a strip of rewettable adhesive.

9. A business form as recited in claim 5 further comprising indicia indicating that postage should be placed on said first face of said return envelope first portion, said postage indicating indicia disposed between said first and second fold lines on said first face.

10. A business form as recited in claim 4 wherein said first fold line is spaced a distance of roughly $2\frac{3}{4}$ inches from said common edge of said first and second portions; and wherein said second fold line is spaced a distance of roughly $\frac{7}{8}$ inch from said first fold line, so that when the envelope is folded about said second fold line the envelope has the approximate dimensions of a standard #$6\frac{3}{4}$ envelope.

11. A business form as recited in claim 4 wherein said second fold line is a line of weakness.

12. A business form as recited in claim 4 wherein said lines of weakness in said mailer are provided in one main panel of said mailer along all four edges of said mailer, and wherein said one main panel having said four lines of weakness has rectangular dimensions of about $2\ 15/16 \times 7\frac{1}{2}$ inches.

13. A business form as recited in claim 4 wherein said lines of weakness are formed adjacent three edges of said sections, and wherein said main panels have dimensions of roughly about $8 \times 3\frac{3}{8}$ inches.

14. A business form as recited in claim 13 wherein address information is provided on said first section readable through a cutout formed in said second section; and wherein said return envelope is nested between said first and third sections.

15. A business form as recited in claim 4 wherein said first, second, and third sections of said sheet are connected together in the marginal areas thereof outside said lines of weakness by pressure sensitive adhesive.

16. A business form comprising:

a mailer formed from a single rectangular sheet having dimensions roughly about $8\frac{1}{2} \times 11$ inch, said sheet Z-folded into three substantially equal sections, comprising first, second, and third sections, along longitudinal fold lines, so that the second section is in contact with both the first and third sections and the mailer has a completed exterior construction of a rectangular sheet roughly about $8\frac{1}{2} \times 3\frac{2}{3}$ inches, and has four borders;

lines of weakness formed in said mailer sections to define in said mailer around at least three of the borders thereof marginal areas that are detachable from main panels of said mailer, said main panels being within said lines of weakness and being rectangular in configuration;

pressure sensitive adhesive connecting said second section to said first and third sections, said pressure sensitive adhesive provided in said marginal areas of each of said sections; and a paper return envelope having a first portion having a length approximately twice that of a second portion, said first portion having a free end, and said first and second portions being connected together to define an envelope pocket having a length approximately equal to that of said second portion, including a common first edge of said first and second portions opposite from said free end of said first portion; a first fold line formed in said first portion at or slightly spaced from said envelope pocket and parallel to said common edge, and a second fold line formed in said first portion between said first fold line and said free end and parallel to said first fold line; said envelope when said first portion is folded about said first fold line having a rectangular shape and dimensions slightly less than the dimensions of said main panels, and said return envelope nested within said mailer between said second section and one of said first and third sections.

17. A business form as recited in claim 16 wherein said first portion of said return envelope has first and second opposite faces, and said second portion has first and second opposite faces; address indicia disposed on a part of said first face overlying said second portion; and a part of said second face of said first portion in face to face contact with said second face of said second portion.

18. A business form as recited in claim 17 further comprising indicia indicating that postage should be placed on said first face of said return envelope first portion, said postage indicating indicia disposed between said first and second fold lines on said first face.

19. A business form comprising:

a mailer formed from a single rectangular sheet having dimensions roughly about $8\frac{1}{2} \times 11$ inch, said sheet C-folded into three substantially equal sections, comprising first, second, and third sections, along longitudinal fold lines, so that the first section is in contact with both the second and third sections and the mailer has a completed exterior construction of a rectangular sheet roughly about $8\frac{1}{2} \times 3\frac{2}{3}$ inches, and has four borders;

lines of weakness formed in said each of said mailer sections to define in said mailer around at least three of the borders thereof marginal areas that are detachable from main panels of said mailer, said main panels being within said lines of weakness and being rectangular in configurating connecting said second section to said first and third sections said adhesive provided in said marginal areas of each of said sections; and a paper return envelope having a first portion having a length approximately twice that of a second portion, said first portion having a free end, and said first and second portions being connected together to define an envelope pocket having a length approximately equal to that of said second portion, including a common first edge of said first and second portions opposite from said free end of said first portion; a first fold line formed in said first portion at or slightly spaced from said envelope pocket and parallel to said common edge, and a second fold line formed in said first portion between said first fold line and said free end and parallel to said first fold line; said envelope when said first portion is folded about said first fold line having a rectangular shape and dimensions slightly less than the dimensions of said main panels, and said return envelope nested within said mailer between said first and third sections.

20. A business form as recited in claim 19 wherein said first portion of said return envelope has first and second opposite faces, and said second portion has first and second opposite faces; address indicia disposed on a part of said first face overlying said second portion; and a part of said second face of said first portion in face to face contact with said second face of said second portion.

21. A business form as recited in claim 20 further comprising indicia indicating that postage should be placed on said first face of said return envelope first portion, said postage indicating indicia disposed between said first and second fold lines on said first face.

* * * * *